US005375753A

United States Patent [19]

Barthauer et al.

[11] Patent Number: 5,375,753

[45] Date of Patent: Dec. 27, 1994

[54] TENSIONING APPARATUS FOR A WEB THREADING ENDLESS ROPE

[75] Inventors: Thomas E. Barthauer; William E. Kelley, both of Urbana, Ohio

[73] Assignee: Wespatt, Inc., Springfield, Ohio

[21] Appl. No.: 130,863

[22] Filed: Oct. 4, 1993

[51] Int. Cl.[5] ..... B65H 59/38

[52] U.S. Cl. ..... 226/92; 226/118; 226/195; 242/47.5; 474/104

[58] Field of Search ..... 226/44, 91, 92, 118, 226/119, 195; 474/104, 110, 136, 137; 242/47.5; 28/241

[56] References Cited

U.S. PATENT DOCUMENTS

| | | | |
|---|---|---|---|
| 2,218,504 | 10/1940 | Cadden | 28/241 |
| 2,359,170 | 9/1944 | Symmes | 28/241 |
| 3,643,497 | 2/1972 | LeCompte | 226/195 X |
| 3,871,205 | 3/1975 | Fenton | 28/241 X |
| 4,186,861 | 2/1980 | Steinhilber | 226/118 |
| 4,288,014 | 9/1981 | Evers | 226/44 |
| 5,263,623 | 11/1993 | Bracken | 226/92 |

*Primary Examiner*—Clifford D. Crowder
*Assistant Examiner*—John J. Calvert
*Attorney, Agent, or Firm*—Jacox & Meckstroth

[57] ABSTRACT

A compact rope stretcher maintains the tension in an endless rope used for threading a web in a papermaking machine and includes a beam having parallel flanges forming tracks which are engaged by guide wheels supporting separate carriages. The carriages support corresponding rope sheaves for free rotation, and a pair of fluid cylinders are mounted on the beam and have piston rods connected directly to the corresponding carriages. The rope sheave on each carriage has at least two peripheral grooves to receive a double loop of the rope, and the frame supports a corresponding multiple groove sheave for each of the carriage sheaves and for also receiving a double loop of the rope.

15 Claims, 2 Drawing Sheets

TENSIONING APPARATUS FOR A WEB THREADING ENDLESS ROPE

CROSS-REFERENCE TO RELATED APPLICATIONS

This application is related to application Ser. No. 07/783,425, filed Oct. 28, 1991 and application Ser. No. 08/105,149 filed Aug. 12, 1993, both of which are assigned to the assignee of this application.

BACKGROUND OF THE INVENTION

In machines for producing a web of paper, or paper board, it is common to direct an endless rope or a pair of endless ropes around the end portions of a series of rolls, such as the rolls of the dryer section or a set of calender rolls, for gripping and threading through the rolls the leading end portion of a web, usually referred to as a "tail". When a single rope is used, it is directed twice around the rolls so that two adjacent ropes extend through the rolls and are effective to pinch the tail and thread it around the rolls. The rope may have a diameter of about one half inch and is usually made of spun nylon filaments or of natural fibers. The rope stretches over a period of use, especially when the rope is driven at a higher speed, for example, over several thousand feet per minute. The ropes can stretch from 7% to 10% within a few days or within a few months depending upon the speed of the papermaking machinery. In the dryer section, the length of the endless rope is frequently between 200 feet and 400 feet so that a 7% to 10% stretch requires substantial take up in the rope in order to maintain the desired rope tension.

In prior art rope stretchers, various types of elongated frames have been fabricated from metal rods and bars of various shapes, and the fabricated steel frames support movable carriages. Flexible cables extend from the carriages around corresponding stationary guide pulleys and also around movable pulleys supported by the extendable piston rods of fluid cylinders. In such a rope stretcher, it is desirable to simplify its construction and to reduce the number of moving parts so that servicing is minimized or substantially eliminated thereby avoiding down time of the papermaking machine in the event the rope stretcher is not properly serviced. It is also desirable to maintain constant tension in the rope to provide dependable and efficient threading of a web tail and to obtain maximum service life from the rope. In addition, it is highly desirable to provide a more compact rope stretcher having a lighter weight and greater strength as well as a rope stretcher which may be installed in any position on papermaking machinery.

The above mentioned applications disclose an improved rope stretcher which provides all of the desirable features and advantages mentioned above, and which is especially simple, economical and dependable in construction. This rope stretcher further eliminates the need to fabricate an elongated track and the use of cable and pulley systems, and it may be easily constructed in various sizes and lengths depending on the length and stretch of the rope and the desired tension in the rope.

In one embodiment of a rope stretcher disclosed in the above applications, an elongated precision track is formed by an H-beam having parallel flanges integrally connected by a center web. Opposite end portions of the beam are supported by mounting brackets, and one of the flanges supports a pair of adjacent parallel carriage plates by a set of sealed anti-friction guide wheels which positively engage opposite longitudinal edge portions of the flange.

Each of the carriage plates supports a rope sheave for free rotation by a sealed anti-friction bearing and is directly connected by a link member to the end portion of a piston rod projecting from a corresponding elongated fluid or air cylinder mounted on the web of the beam. A pair of proximity sensors are mounted on opposite end portions of the beam to detect the presence of the carriages and actuate a signal or alarm when the stretch in the rope is approaching a limit. A longitudinally extending cover extends over the beam and carriages to protect the carriages and fluid cylinders.

SUMMARY OF THE INVENTION

The present invention provides a rope stretcher which is designed and constructed for installation on paper machines where the space for mounting a rope stretcher is limited. In the rope stretcher of the invention, which is not limited to use in confined spaces, there is only one sheave-supporting carriage for a single rope mounted for movement on the frame. A second sheave has a stationary mounting on the frame, and each of these sheaves has a pair of peripheral grooves to receive a double loop of the rope.

In this apparatus, therefore, the amount of rope forming the loops around the two sheaves is double in length the amount where each of two movable sheaves has a single groove, as in FIGS. 1–5. Any specific extent of tensioning movement of the movable sheave will therefore produce double the tensioning effect of the same amount of movement in the apparatus shown in FIGS. 1–5. Or to describe the same feature from the opposite standpoint, a desired extent of tensioning of the rope can be obtained with one-half of the movement of the movable carriage as compared with the apparatus of FIGS. 1–4 wherein there are two movable sheaves for tensioning the same rope.

The advantages of the invention are not limited to a rope stretcher wherein there is a single sheave-supporting carriage on the frame. The same advantage of increased tensioning effect for the same amount of movement of movable sheaves is achieved with the apparatus of FIGS. 1–4 modified to include a carriage and fluid operator supported by each side of the frame and with each carriage supporting a double groove sheave.

Other features and advantages of the invention will be apparent from the following description, the accompanying drawings and the appended claims.

DESCRIPTION OF THE PREFERRED EMBODIMENTS

Figure 1:
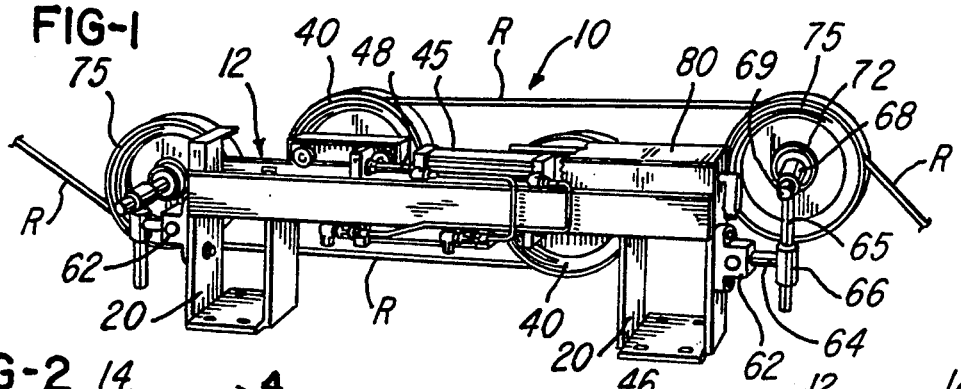
FIG. 1 is a perspective view of a rope stretcher or tensioning apparatus disclosed in the above mentioned applications and with a portion of a cover guard broken away to show internal assembly.

FIG. 1 illustrates a rope tensioning apparatus or rope stretcher 10 as disclosed in the above mentioned applications and through which extends an endless rope R that may have a diameter of about one half inch and may be constructed of spun nylon filaments or natural fibers. As used herein, the term "rope" includes any flexible endless element which is used to grip the tail of a web of material for threading the web through a series of processing rolls.

The rope stretcher 10 includes an elongated frame 12 (FIG. 4) formed by a steel H-beam having a pair of parallel flanges 14 integrally connected by a web 16. The size of the H-beam frame 12 is selected according to the length and expected stretch of the rope R and the desired tension within the rope. For example, the flanges 14 may have a width ranging between three inches to fourteen inches and the length may range between five feet and twenty feet. The H-beam frame 12 has opposite end portions 18 which are supported by corresponding U-shaped mounting brackets 20 preferably welded to the end portions of the beam.

Figure 2:
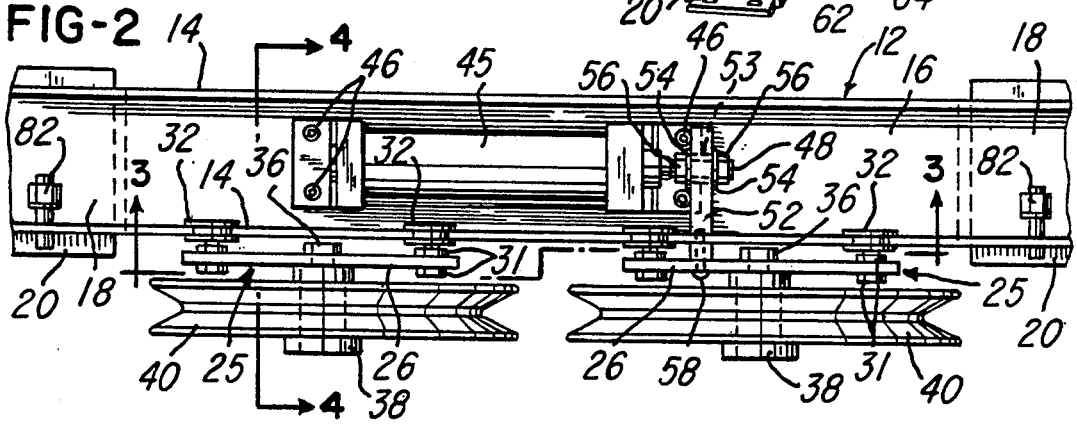
FIG. 2 is a fragmentary plan view of the apparatus shown in FIG. 1.
Figure 3:
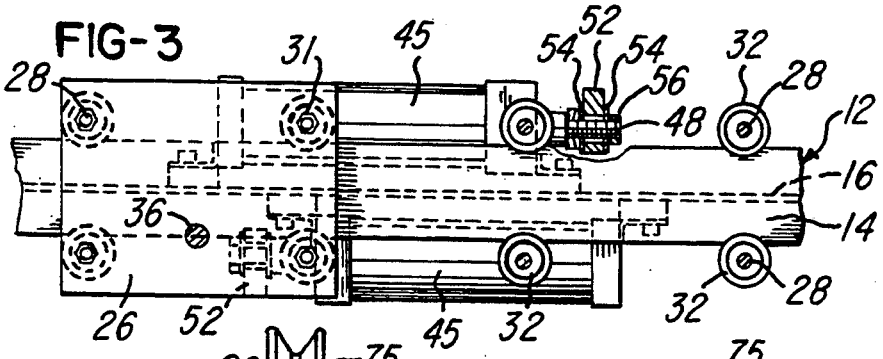
FIG. 3 is a fragmentary section taken generally on the line 3—3 of FIG. 2.
Figure 4:
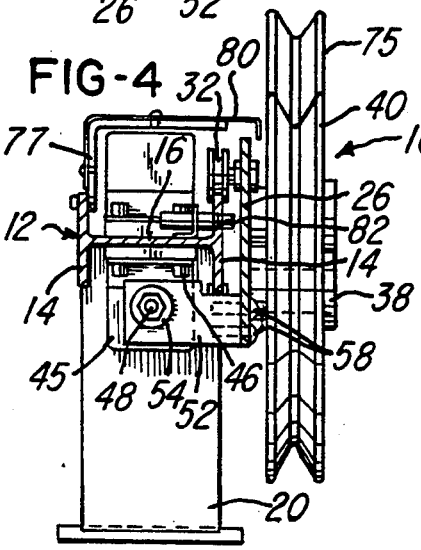
FIG. 4 is a section taken generally on the line 4—4 of FIG. 2.

As shown in FIGS. 2–4, a pair of carriages 25 are supported for smooth longitudinal movement by one of the flanges 14 of the beam 12, and each carriage 25 includes a rectangular carriage plate 26 having a width greater than the width of the adjacent parallel flange 14. A set of four stainless shafts 28 are secured to the corner portions of each of the carriage plates 26 by a set of threaded nuts 31, and each shaft 28 supports a stainless steel spool-like guide wheel 32 having a sealed anti-friction bearing mounted on the shaft 28.

The guide wheels 32 on each carriage plate 26 are constructed to engage closely the opposite longitudinally extending edge portions of the adjacent beam flange 14 and support the carriage plate 26 for smooth and precision linear movement along the length of the beam 12. A locking screw 36 is located on the inner side of each carriage plate 26 and is threaded onto the end portion of a shaft 38 which supports a rope sheave 40 having a sealed anti-friction center bearing mounted on the shaft 38 to provide free rotation of the sheave 40.

An elongated fluid pressure cylinder 45, preferably pneumatic, is mounted on the web portion 16 of the H-beam 12 for each of the carriages 25, with the cylinders 45 located on opposite sides of the web 16. Each of the cylinders 45 is secured by a set of screws 46 and includes a piston rod 48 having a threaded outer end portion. A laterally projecting link member 52 has a bore 53 which receives the outer end portion of the rod 48, and the bore 53 is somewhat larger than the diameter of the rod 48. A pair of flat washers 54 and corresponding nuts 56 retain the link member 52 on the rod 48 adjacent a pair of opposing cup-shaped spring washers which permit the link member 52 to float laterally by a slight amount relative to the rod 48 to avoid any lateral stress on the piston rod.

Two screws 58 rigidly secure each of the link members 52 to the corresponding carriage plate 26 so that axial movement of the piston rod 48 of each cylinder 45 is effective to move the corresponding carriage 25 and sheave 40 longitudinally of the track formed by the supporting beam flange 14. The cylinders 45 are connected to air supply lines (not shown) which extend from an electronic control system (not shown) which is adjusted to control the pressure of the air supply to the cylinders 45. The air pressure behind the piston rods 48 normally urges the rods 48 outwardly for urging the carriages 25 longitudinally towards the opposite corresponding end portions 18 of the H-beam 12.

As shown in FIG. 1, a block 62 is mounted on the outer end of each beam support bracket 20 and supports a rod 64 to which is secured a cylindrical bushing 66. Another rod 65 is adjustably supported by the bushing 66 and is secured to another bushing 68. The bushing 68 supports an axially adjustable shaft 69 on which is mounted an anti-friction bearing 72 supporting a freely rotatable rope guide sheave 75. As also shown in FIG. 1, the endless rope R extends under one of the end guide sheaves 75 and more than 180° around each of the carriage supported sheaves 40 and then over the other guide sheave 75 at the opposite or right end of the rope stretcher 10. The rope R then extends around the end portions of the rolls (not shown) of the paper making or web processing machine. Referring to FIG. 4, a series of longitudinally spaced angle brackets 77 are secured to the other flange 14 of the H-beam 12 and support a right angle sheet metal cover guard 80 which extends the full length of the beam 12.

Figure 5:
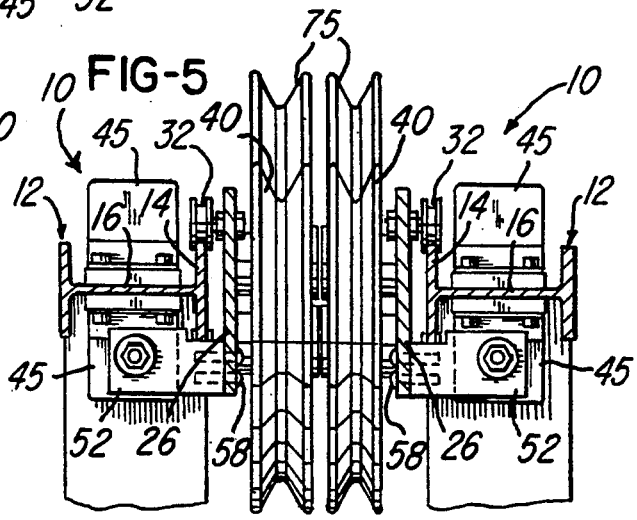
FIG. 5 is a section similar to FIG. 4 of dual tensioning apparatus for stretching a pair of ropes.

Referring to FIG. 5, a pair of the rope stretchers 10 described above in connection with FIGS. 1–4 are arranged in adjacent relation to form a double rope stretcher for handling a pair of endless ropes. Preferably, when two of the rope stretchers 10 are used, they are arranged so that the sheaves 40 define adjacent parallel paths with the sheaves positioned in closely spaced opposing relation. The end support brackets 20 for each H-beam frame 12 are rigidly secured together by welding a connecting bottom plate (not shown).

As shown in FIG. 2, when air is supplied to the cylinders 45 at a predetermined pressure, the outward forces on the piston rods 48 tend to separate the sheaves 40 and maintain a predetermined tension within the rope R according to the selected pressure within the cylinders 45. In order to detect the extent of stretch within the rope R as compensated for by the outwardly movable carriages 25, a pair of electronic proximity sensors 82 are supported by the opposite end portions 18 of the H-beam 12 directly above the mounting brackets 20. Each of the sensors 82 detects when the corresponding carriage 25 is within a predetermined distance, for example, about ten inches. When one of the sensors 82 is activated, it closes an electrical circuit to activate a flashing light or an audible alarm for indicating that the maximum allowable stretch within the rope R is approaching.

Figure 6:
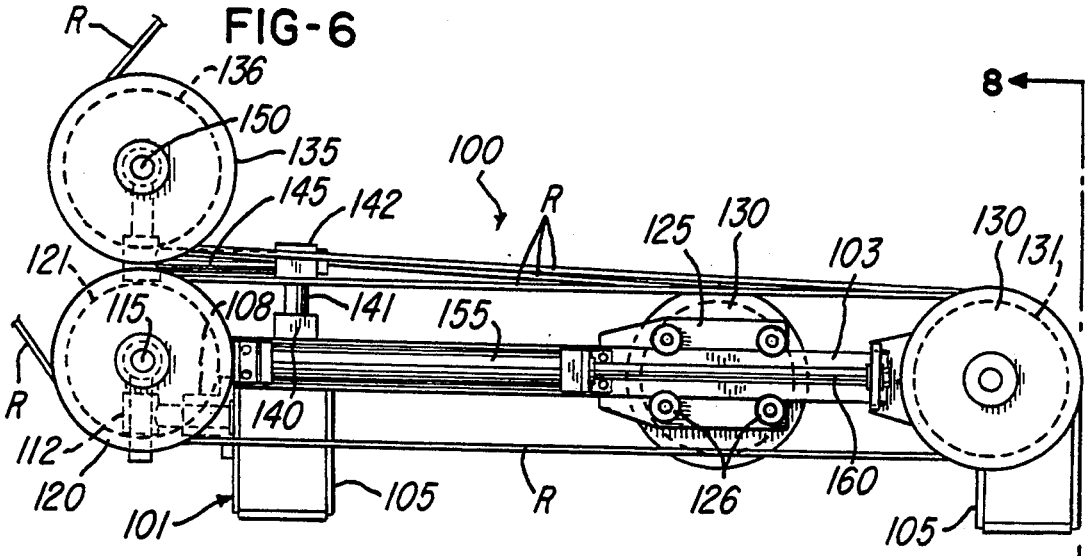
FIG. 6 is a side elevation of a double-loop rope stretcher constructed in accordance with the present invention.
Figure 7:
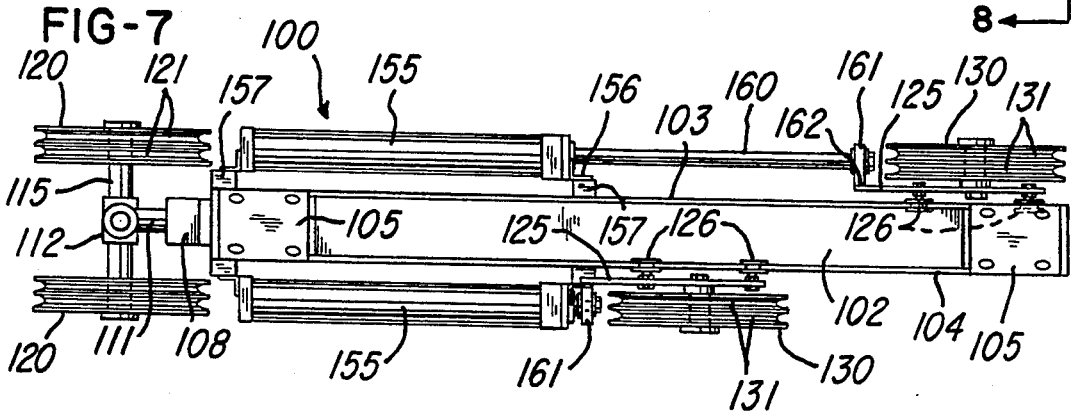
FIG. 7 is a bottom view of the stretcher shown in FIG. 6.
Figure 8:
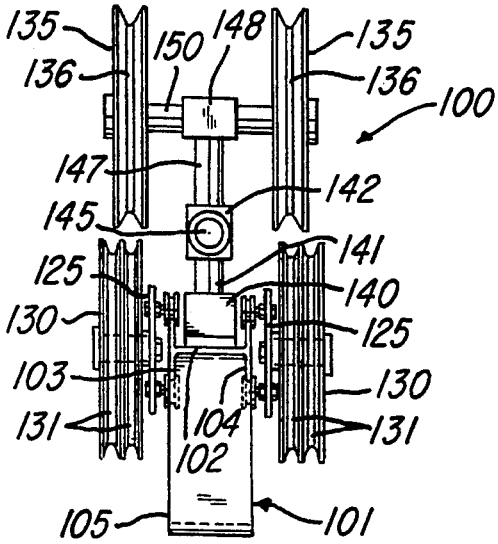
FIG. 8 is an end view looking from right to left in FIG. 6.

FIGS. 6–8 illustrate a rope stretcher 100 constructed in accordance with the invention and which, like the rope stretcher shown in FIG. 5, is designed to handle a pair of ropes. It differs from the apparatus shown in FIGS. 1–5 in two major structural respects. One is that there is only one sheave for each rope mounted for movement on each side of a frame 101, and the movable sheave cooperates with a sheave having a stationary mounting on the frame. The other is that each of these sheaves has a pair of rope-receiving grooves in its periphery to receive a double loop of the rope.

In FIGS. 6 & 7, the frame 101 is shown as essentially identical with the frame 12 in that it comprises an H-beam including a central web 102 integrally connecting a pair of parallel side flanges 103 and 104. A mounting bracket 105 is secured to web 102 at each end of the frame, and a mounting block 108 is secured to one end of the frame 101 for supporting a rod 111. A T-fitting 112 is secured on the outer end of the rod 111 and supports a cross shaft 115 extending in both directions from the fitting 112 at right angles to rod 111. A sheave 120 is mounted for free rotation on each end of the shaft 115, and as shown in FIG. 7, each sheave 120 has a pair of rope-receiving grooves 121 around its periphery.

A single carriage 125, which is constructed substantially the same as the carriage 25, is mounted on each of the flanges 103 and 104 by two pairs of grooved rollers 126 constructed the same as the rollers 32. Each carriage 125 supports a sheave 130 which is mounted for free rotation by the same shaft and lock screw arrangement described above in connection with FIG. 2. Like the sheaves 120, each sheave 130 has a pair of peripheral grooves 131 for receiving a double loop of a rope R.

A single stationary guide sheave 135 (FIGS. 6 & 8) having a single groove 136, is provided for each pair of sheaves 120 and 130. Referring to FIG. 8, the support for each sheave 135 includes a block 140 mounted on one end of the web 102 and supporting a vertically extending rod 141. A fitting 142 is mounted on the upper end of the rod 141 and supports a horizontally extending rod 145. A fitting is secured to the other end of the rod 145 and supports a vertically extending rod 147. A T-fitting 148 is secured to the upper end of the rod 147 and supports a cross shaft 150 having one of the sheaves 135 mounted for free rotation on each end thereof in vertically aligned relation with its associated sheave 120.

A fluid or pneumatic cylinder 155 is mounted on each of the flanges 103 and 104, and each cylinder 155 is positioned by means of angle brackets 156 and spacers 157 so that the axis of its piston rod 160 is in essentially centered relation or aligned with the center of the corresponding sheave 130. This arrangement makes it possible to connect the piston rod with its associated carriage 125 by a steel bar 161 having one edge 162 welded to the carriage 125. As shown in FIG. 7, the welded bar 161 is relatively thick to form a rigid connection of the piston rod 160 to the carriage 125 so that the thrust of the piston rod 160 is applied in what is effectively a direct line to the center plane of the associated sheave 130.

In the apparatus shown in FIGS. 1–5, the sheaves 75 merely guide the rope to or from the nearest sheave 40 and do not contribute to the rope tensioning action. In contrast with the present invention, each of the stationarily mounted sheaves 120 cooperates with its associated sheave 130 in the tensioning operation, and the guiding function for each pair of sheaves 120 and 130 is performed by one of the single-grooved sheaves 135. Further, since each rope R is looped twice around each of its associated sheaves, a given amount of movement of the movable sheave 130 away from the stationary sheave 120 will take up twice as much rope as the same amount of relative movement of the sheaves 25 in the apparatus of FIGS. 1–5.

A number of practical advantages flow from this double loop stretcher. For example, each rope R requires only two sheaves, one carriage and one cylinder as compared with the apparatus of FIGS. 1–5 which requires four sheaves, two carriages and two cylinders for each rope. In addition, since the apparatus of the invention requires only one-half of the total movement of the movable sheaves which is required by the apparatus of FIG. 1 for the same amount of take-up of a rope, the overall length of the apparatus of the invention can be correspondingly less. Also, the stretcher 100 may be mounted in any position such as horizontal, vertical or on an incline.

A still further operating advantage provided by the invention is that each cylinder and carriage are constructed and arranged to deliver the thrust of each piston rod in substantially a direct line through the center plane of the associated sheave. As a result, the force of each cylinder is used more effectively and efficiently, and this substantially eliminates side thrust on the piston rod and minimizes wear of the of the cylinder components.

The advantages provided by the present invention are not limited to the rope stretching apparatus shown in FIGS. 6–8, and some can be obtained by suitable modification of the apparatus shown in FIGS. 1–5. More specifically, the same advantage of one-half the amount of movement of each movable pair of sheaves for the same amount of rope take-up can be obtained by replacing the single rope sheaves 40 and 75 shown in FIGS. 1–5 with double rope sheaves 120 and 130. The operation of this modified form of the invention is in general the same as already described for the apparatus shown in FIGS. 1–4, except that by reason of the double grooved sheaves and the double loop of the rope, a given amount of relative movement of each pair of associated carriages 25 will produce twice the amount of take-up of the associated rope as that amount of sheave movement will produce with the apparatus of FIGS. 1–4.

It will of course be apparent that since each side of the apparatus in FIG. 5 is independent of the other side, the same compactness and operating advantages can be obtained with the apparatus of FIG. 5 by substituting double grooved sheaves for the single groove sheaves 40 and 75. It is also to be understood that any of the forms of the invention shown in or described in connection with FIGS. 6–8 may be equipped with proximity sensors as described with reference to the sensors 82 in FIG. 2.

While the forms of tensioning apparatus herein described constitute preferred embodiments of the invention, it is to be understood that the invention is not limited to these precise forms of apparatus, and that changes may be made therein without departing from the scope and spirit of the invention as defined in the appended claims.

The invention having thus been described, the following is claimed:

1. Apparatus for tensioning an endless rope used for threading a web in a papermaking machine and for taking up stretch which develops in a rope over a period of use, comprising a frame including an elongated track, a first sheave supported for free rotation by said frame and positioned to be partially wrapped by the rope, a carriage mounted for longitudinal movement on said track toward and away from said first sheave, a second sheave supported for free rotation by said carriage in position to be partially wrapped by a loop of the rope wrapping said first sheave, each of said sheaves having at least two peripheral grooves to receive a double loop of the rope, a fluid pressure cylinder including a piston rod projecting from one end thereof, and means connecting said cylinder and said piston rod to said frame and said carriage to effect movement of said carriage and said second sheave with respect to said first sheave.

2. Apparatus as defined in claim 1 and including a second said carriage mounted for longitudinal movement on said track, means mounting another said second sheave for free rotation on said second carriage, a second said fluid pressure cylinder including a piston rod projecting from one end thereof, and means connecting said second fluid cylinder and the corresponding said piston rod to said frame and said second carriage for independently moving said carriages.

3. Apparatus as defined in claim 1 and including means forming a stationary mounting on said frame for said first sheave.

4. Apparatus as defined in claim 1 where in said track has a side surface, and said cylinder is mounted on said side surface in substantially aligned relation with a center plane defined between said groves within said second sheave on said carriage.

5. Apparatus as defined in claim 1 wherein said track comprises longitudinally extending parallel spaced flanges having center portions rigidly connected by a longitudinally extending web to form an H-shaped cross-sectional configuration, and said carriage is mounted on one of said flanges for longitudinal movement.

6. Apparatus as defined in claim 5 wherein said cylinder is also mounted on said one flange.

7. Apparatus for tensioning an endless rope used for threading a web in a paper making machine and for taking up stretch which develops in a rope over a period of use, comprising a frame including an elongated track, a first sheave mounted for free rotation on a stationary mounting secured to said frame, a carriage mounted for longitudinal movement on said track, a second sheave supported for free rotation by said carriage in position to be at least partially wrapped by the rope, each of said sheaves having at least two peripheral grooves to receive a double loop of the rope, a fluid pressure cylinder mounted on said frame, said cylinder including a piston rod projecting from one end thereof, and means forming a direct connection between said projecting piston rod and said carriage to effect movement of said carriage and said second sheave with respect to said first sheave in response to actuation of said cylinder.

8. Apparatus as defined in cl aim 7 where in said track has a side surface, and said cylinder is mounted on said side surface in substantially aligned relation with a center plane defined between said grooves within said second sheave on said carriage.

9. Apparatus as defined in claim 7 wherein said connecting means between said piston rod and said carriage comprises a rigid member connecting said piston rod directly to said carriage.

10. Apparatus for tensioning an endless rope used for threading a web in a papermaking machine and for taking up stretch which develops in the rope over a period of use, comprising a frame including an elongated track having at least one longitudinally extending and substantially flat flange, said track also including a longitudinally extending web connected to said flange and projecting generally perpendicular to said flange, at least one carriage including a base member disposed adjacent and generally parallel to said flange, means mounted on said base member outboard of said flange and engaging said flange to support said carriage for longitudinal movement along said track, at least one elongated fluid cylinder extending longitudinally of said track and having a piston rod, means for securing said cylinder to said track, means for connecting said piston rod to said carriage and providing for movement of said carriage along said flange in response to actuation of said cylinder, a first sheave supported by said base member of said carriage for free rotation and having at least two peripheral grooves for receiving a double loop of the rope, and a second sheave supported by said frame for free rotation and having at least two peripheral grooves for receiving a double loop of the rope.

11. Apparatus as defined in claim 10 wherein said track comprises two longitudinally extending and parallel spaced said flanges having center portions rigidly connected by said longitudinally extending web to form an H-shaped cross-sectional configuration.

12. Apparatus as defined in claim 10 wherein said cylinder is also mounted on said one flange.

13. Apparatus as defined in claim 10 and including a second said carriage mounted for longitudinal movement on said track, means mounting another said first sheave for free rotation on said second carriage, a second said fluid pressure cylinder including a piston rod projecting from one end thereof, and means connecting said second fluid cylinder and the corresponding said piston rod to said frame and said second carriage for independently moving said carriages.

14. Apparatus as defined in claim 10 and including means forming a stationary mounting on said frame for said second sheave.

15. Apparatus as defined in claim 10 wherein said flange has an outer side surface, and said cylinder is mounted on said side surface in substantially aligned relation with a center plane defined between said groves within said first sheave on said carriage.

* * * * *